United States Patent [19]

Svensson

[11] Patent Number: 4,646,616

[45] Date of Patent: Mar. 3, 1987

[54] HATCH COVER FOR A COMBAT VEHICLE

[75] Inventor: Hakan Svensson, Karlskoga, Sweden

[73] Assignee: Aktiebolaget Bofors, Sweden

[21] Appl. No.: 730,915

[22] Filed: May 6, 1985

[30] Foreign Application Priority Data

May 4, 1984 [SE] Sweden ..... 8402411

[51] Int. Cl.[4] ..... F41H 5/20

[52] U.S. Cl. ..... 89/36.14; 109/58.5; 109/74

[58] Field of Search ..... 89/36.14, 36.13, 36.08; 109/58, 58.5, 73, 74

[56] References Cited

U.S. PATENT DOCUMENTS

| | | | |
|---|---|---|---|
| 126,133 | 4/1872 | Corliss | 109/58 |
| 1,447,462 | 3/1923 | Butscher et al. | 109/58 |
| 3,241,446 | 3/1966 | Wey | 89/36.13 |
| 3,994,202 | 11/1976 | Tidstrom | 89/36.14 |

FOREIGN PATENT DOCUMENTS 1281084 7/1972 United Kingdom .

*Primary Examiner*—Deborah L. Kyle
*Assistant Examiner*—John S. Maples
*Attorney, Agent, or Firm*—Pollock, Vande Sande & Priddy

[57] ABSTRACT

An armored hatch cover for a combat vehicle which covers the hatch opening in the vehicle turret is pivotally mounted between an open position which provides essentially circumferential direct observation from the hatch and a closed position in which the cover seats upon a margin in the turret, sealing the hatch opening. In the open position the cover protects the hatch opening and forms a small annular gap between the lower part of the cover and the margin to allow circumferential observation. The cover has a downwardly extending front part which provides additional front armor protection when in a closed position.

3 Claims, 4 Drawing Figures

HATCH COVER FOR A COMBAT VEHICLE

BACKGROUND OF THE INVENTION

The present invention relates to an armored hatch cover for an observation opening (hatch) on the top of a combat vehicle, preferably on the turret, for protecting a crew member of the vehicle, preferably the commander. The hatch cover is pivotally mounted between an open position providing a substantially unobstructed view all around the vehicle from the hatch and a closed position in which the cover seats upon a margin on the top of the vehicle and seals the opening.

To protect the crew members of a combat vehicle the interior of such vehicle is normally fully encapsulated within an armor protection. For observation and maneuvering of the vehicle in a combat situation the crew members must use periscopes, sighting telescopes and possible small gaps protected by bullet-proof glass windows. To facilitate maneuvering the vehicle during transport operations and also to facilitate observation of the surrounding area, a combat vehicle is normally provided with one or more hatches. Such hatches are normally closed by armored covers which are movable between closed and open positions providing a direct view of the surroundings instead of an indirect view through a periscope.

With the cover in open position the crew members are physically unprotected from enemy fire. In order to obtain a direct view all around the horizon the commander must move his head up to a fully unprotected position above the top line of the vehicle. The crew members are of course fully aware of this dangerous position but nevertheless, also during critical combat situations, this position is often used since it provides for much better observation of the surroundings.

The object of the present invention is to provide a hatch cover which provides substantially unlimited circumferential observation of the surrounding area in open position but still provides a high degree of protection for the crew members.

BRIEF DESCRIPTION OF THE DRAWINGS

In the following discussion, the invention will be more fully described with reference to the accompanying drawings in which FIGS. 1 and 2 schematically illustrate the turret of a combat vehicle in a side view and from above, respectively, specifically showing the location of the hatch cover.

DESCRIPTION OF THE PREFERRED EMBODIMENTS

Figure 1:
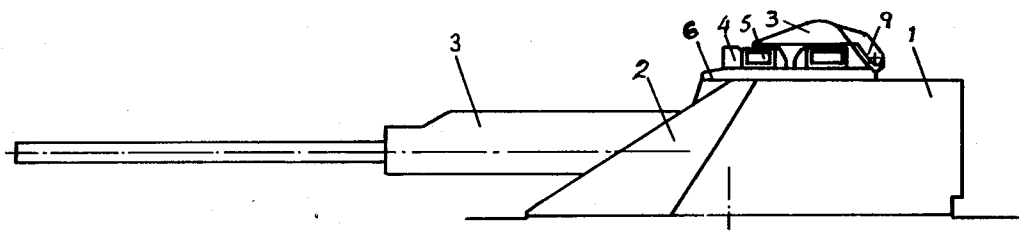
Figure 2:
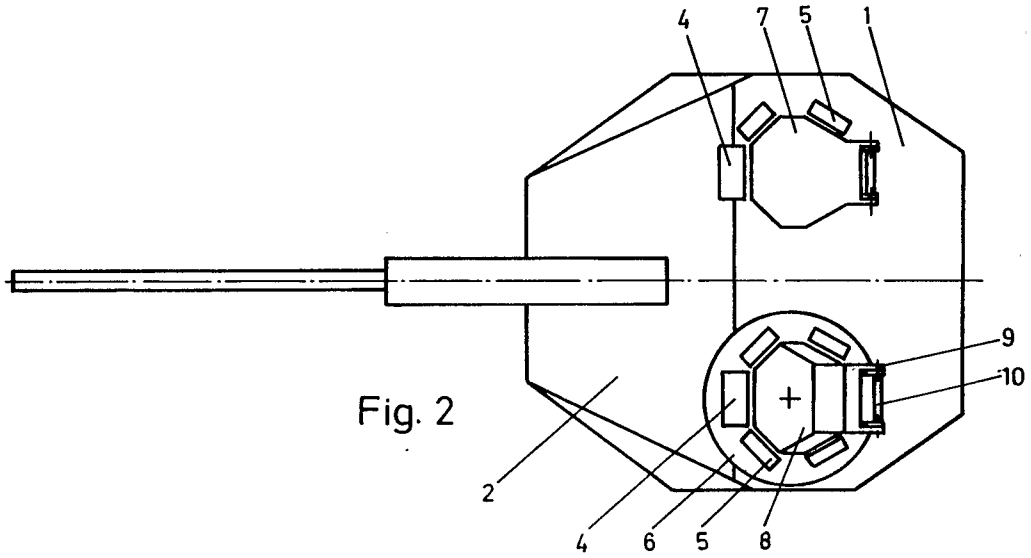

In FIGS. 1 and 2 the turret body 1 of a combat vehicle, for instance a tank, an armored infantry wagon or the like is illustrated. The turret body 1 is rotatably mounted on the top of the vehicle and has an inclined front surface 2 and a large-caliber firearm 3 mounted for elevation.

Space is provided for the crew members within the turret as high as possible within the vehicle to allow good visibility of the surrounding area. Furthermore a high degree of protection is provided by the inclined front surface of the turret. In the embodiment illustrated in FIGS. 1 and 2 there are two crew compartments within the turret, each of which is provided with a sight

4 directed forwardly and parallel to the gun barrel. A number of periscopes 5 extend above the turret roof allowing observation of the surrounding area from within a complete armor protected turret. The periscopes 5 are mounted in a weapon cupola 6 which extends around each crew compartment so that the surrounding area can be observed in different directions, preferably in the proximate forward and rearward directions.

From the protection point of view it is an advantage of the present invention that the interior of the vehicle be fully encapsulated by armor. However, the indirect view provided by sights and periscopes makes it difficult to observe the surrounding area and maneuver the vehicle. Therefore it should also be possible to directly view the surrounding area to facilitate maneuvering the vehicle especially during transport from one place to another. On the top of the turret weapon cupola 6 there are two openings which allow access to the interior of the vehicle and provide direct observation of the surrounding area through the openings.

The observation openings (hatches) are each protected by armored covers 7, 8 which are pivotally mounted between an open position from which a direct view of the surrounding area can be obtained and a closed position in which the covers seat upon a margin or the like mounted between the protruding periscopes on the turret roof.

According to the present invention one of the hatches is provided with a conventional cover 7 which can be opened, but the other of the two hatches, preferably the one in the commanders cupola, is provided with armored cover 8. Cover 8 is provided with a calotte-formed upper part extending well above the periscopes and forming inclined front and side surfaces. The cover member is pivotally supported on a bolt 10 behind the cover by means of two arms 9.

Figure 3:
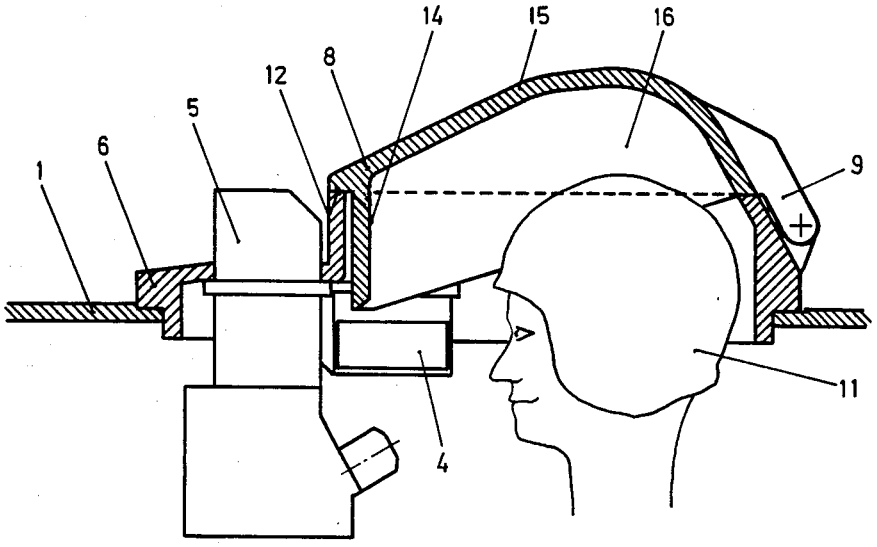
FIGS. 3 and 4 illustrate the cover closed and open, respectively, in a side view.
Figure 4:
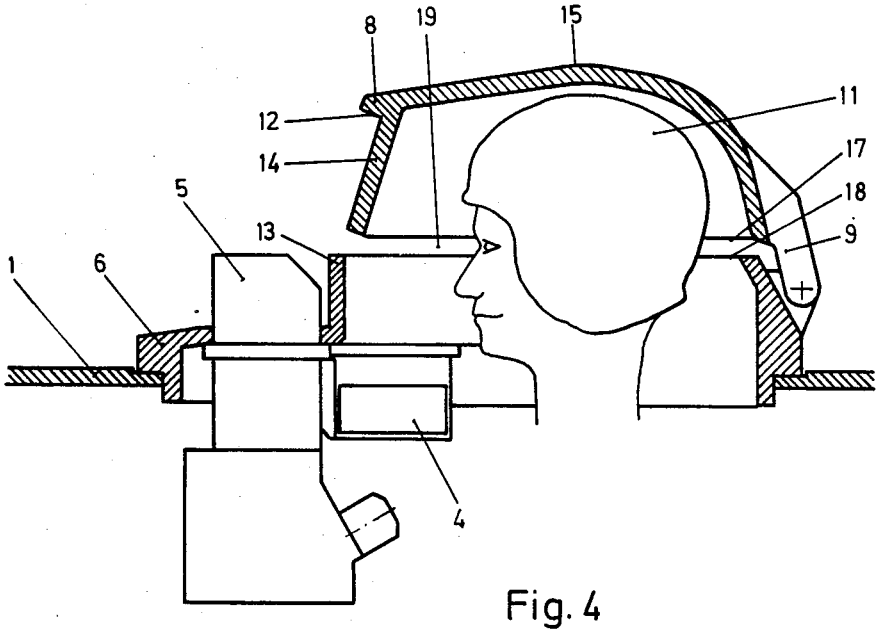

FIGS. 3 and 4 illustrate in greater detail the cover construction and location relative to the head position 11 of a crew member when observing his surroundings through a periscope 4, see FIG. 3, and by direct view, see FIG. 4. When the cover is closed annular surface 12 of the cover seats upon margin 13 or the like in weapon cupola 6. As illustrated in the Figure the cover is provided with front part 14 which extends downwardly providing extra front protection by double, parallel armored plates formed by the margin and the cover part 14. As is also illustrated in FIG. 3 the calotte-formed upper part 15 of the cover extends well above the periscope and sight devices forming free space 16 between the calotte-formed part 15 of the cover and the head of a crew member when he is observing his surroundings through the periscope 4. As is shown in FIG. 3, in the closed position the lower edge of the cover is at an acute angle to the top surface 18 of the margin.

In FIG. 4 the cover is shown in open position in which it is spaced from the hatch opening so that the lower part 17 of the cover and the lower edge of armored plate member 14 are parallel to the top surface 18 of the margin forming a small annular gap 19 between the cover and the margin which provides a substantially unlimited all around view inhibited only by two small rearwardly extending arms 9. The upper surface 18 of the margin is located on substantially the same level or slightly above the protruding sight and periscope devices so that they do not prevent direct observation.

From FIG. 4 it is also clear that the downwardly extending front part 14 provides armor protection in the forward side directions for the observer 11 and also that the space 16 within the cover allows the observer to keep his head in a position which allows free all-around observation.

To facilitate use of the cover the members 9, 10 are preferably provided with spring means to assist in opening the cover and locking means for locking the cover in closed and open positions, respectively. Because the cover is comparatively heavy some type of support means may be required at its front part. Such support means may be formed similarly to arms 9, comparatively small so that they only inhibit all around observation through the small gap 19 to a very small extent. The spring means, locking means and supporting means are conventional details and are not described here in detail.

The invention is not limited to the above embodiment but can be varied within the scope of the following claims. In the illustrated example only one of the two hatches is provided with a cover according to the invention. It should be understood, however, that both of the openings can be provided with such covers.

Furthermore only two positions of the covers have been described, i.e. closed and open position and in open position we mean the "parallel position" for observation purposes. It should be understood, however, that the cover also has a third, fully opened position allowing access through the hatch into the crew compartments of the turret. Such an open position of the cover is well known in the art, however, and has therefore not been described here in any detail.

I claim:

1. An armored hatch cover assembly for covering a hatch opening of a combat vehicle comprising:

a margin surrounding said hatch opening;

a cover pivotally mounted on a bolt member located behind said cover on the top of the vehicle for pivoting between an open and a closed position, said cover having a calotte-formed upper portion having front and rear parts and a substantially annular bottom portion; and an armored plate member having a lower edge and extending downwardly from said annular bottom portion of said cover at said front part, wherein in said open position the said lower edge of said armored plate member and the lower edge of said cover are substantially parallel to the top surface of said margin forming an annular gap extending around the hatch opening to provide a circumferential direct view of the surrounding area, and in said closed position, the lower edge of said cover is at an acute angle with respect to the top surface of said margin, and said armored plate member extends within the margin substantially parallel to the wall of the margin, to provide increased double front protection.

2. A cover assembly according to claim 1 wherein said assembly further comprises rearwardly extending arms having one end connected to the rear part of said cover and opposite ends pivotally mounted on said bolt member.

3. A cover assembly according to claim 1 wherein said assembly is adapted to assume a third fully opened position providing free access through the hatch opening to the crew compartments in the vehicle.

* * * * *